US010688006B2

(12) United States Patent
Seltzer

(10) Patent No.: US 10,688,006 B2
(45) Date of Patent: Jun. 23, 2020

(54) STUFFED ANIMAL PET URN

(71) Applicant: Michael Gary Seltzer, Holly Springs, NC (US)

(72) Inventor: Michael Gary Seltzer, Holly Springs, NC (US)

( * ) Notice: Subject to any disclaimer, the term of this patent is extended or adjusted under 35 U.S.C. 154(b) by 97 days.

(21) Appl. No.: 15/923,005

(22) Filed: Mar. 16, 2018

(65) Prior Publication Data

US 2019/0070056 A1 Mar. 7, 2019

Related U.S. Application Data

(60) Provisional application No. 62/605,950, filed on Sep. 5, 2017.

(51) Int. Cl.
*A61G 17/08* (2006.01)
*A63H 3/02* (2006.01)
*A63H 9/00* (2006.01)

(52) U.S. Cl.
CPC ..... *A61G 17/08* (2013.01); *A63H 3/02* (2013.01); *A63H 9/00* (2013.01)

(58) Field of Classification Search
CPC ..... A61G 17/08; A63H 3/02; A63H 9/00
USPC ..... 27/1; 446/369, 73
See application file for complete search history.

(56) References Cited

U.S. PATENT DOCUMENTS 5,009,626 A * 4/1991 Katz ..... A63H 3/02 156/59
6,023,822 A * 2/2000 Luebke ..... A61G 17/08 27/1
6,785,938 B1 * 9/2004 Johansen, Jr. ..... A61G 17/08 27/1
7,308,741 B1 * 12/2007 Rydberg ..... A61G 17/08 27/1
D629,584 S * 12/2010 Riehl ..... D99/5
9,925,470 B1 * 3/2018 Palacio ..... A63H 3/005
10,272,348 B2 * 4/2019 Brant ..... A63H 3/005
2001/0056309 A1 * 12/2001 Jain ..... G05B 19/4207 700/98
2002/0100152 A1 * 8/2002 Ortega ..... A61G 17/08 27/1
2002/0168919 A1 * 11/2002 Perkins ..... A63H 3/005 446/369
2003/0154581 A1 * 8/2003 Jain ..... A61G 17/08 27/1
2006/0059669 A1 * 3/2006 Rose ..... A61G 17/08 27/1
2009/0025194 A1 * 1/2009 Pearce ..... A61G 17/08 27/1

(Continued)

FOREIGN PATENT DOCUMENTS

CA 2639274 A1 * 3/2010 ..... A61G 17/08
JP 3143034 U * 7/2008

*Primary Examiner* — William L Miller
(74) *Attorney, Agent, or Firm* — Olive Law Group, PLLC

(57) ABSTRACT

Methods and devices for producing a stuffed animal pet urn are disclosed. According to an aspect of the present disclosure, the method includes receiving a plurality of photographic viewpoints of a pet body and creating a three-dimensional model based on the received plurality of photographic viewpoints, in which the three-dimensional model includes a hollow internal compartment. The method also includes producing a stuffed animal based on the three-dimensional model.

6 Claims, 4 Drawing Sheets

(56) References Cited

U.S. PATENT DOCUMENTS

| | | | | |
|---|---|---|---|---|
| 2013/0152348 | A1* | 6/2013 | Taylor | A61G 17/08 27/1 |
| 2017/0128305 | A1* | 5/2017 | Saari | A61G 17/08 |

* cited by examiner

STUFFED ANIMAL PET URN

CROSS REFERENCE TO RELATED APPLICATION

This application claims priority to U.S. Provisional Patent Application 62/605,950 filed Sep. 5, 2017 and titled STUFFED ANIMAL PET URN, the entire content of which is incorporated herein by reference in its entirety.

TECHNICAL FIELD

The presently disclosed subject matter relates to stuffed animal pet urn. More particularly, the presently disclosed subject matter relates to methods and devices for producing a stuffed animal pet urn.

BACKGROUND

In recent years, cremation has been a viable option for families or individuals who have lost loved ones in order to honor their memory among other things. Cremation is both cost effective and convenient for the families. It allows a family member to retain the remains of the individual cremated for years on end. In order to effectively secure and retain the remains of an individual who has been cremated, cremation urns were created. Cremation urns are designed to store the ashes of a loved one. They are sculpted to be attractive and uniquely tailored to resemble the personality of the dearly departed. Cremation urns take the form of wooden, stone, metal, or ceramic vessels. These vessels are in the shape of boxes, vases, figurines, and statues. Although it is common to cremate and store the ashes of family members, it has become increasingly popular to cremate recently departed pets and store their ashes in urns called pet urns. These pet urns also take the form of boxes, vases, figurines and statues made up of wood, stone, metal or ceramic.

In order to fully appreciate the intimacy of pet urn that houses the ashes of a loved pet, the likeness of that loved pet is reduced to a picture or sculpted ornament. For instance, it is common to attach pictures to a pet urn or even sculpt a statue to resemble the face or body of the departed pet. While the process of using pet urns is common, the pet urns are limited to being characterized and utilized as stationery sculpted vessels that are delicate, untouchable, lifeless, and incapable of fully realizing the likeness or resemblance of your pet. A pet urn mirroring the likeness of a departed pet should have the look and feel of the pet. It should include fur and feel life-like. Thus, what is needed is a process of producing a stuffed animal pet urn that closely resembles the likeness of a dearly departed pet.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Disclosed herein are methods and devices for producing a stuffed animal pet urn. According to an aspect, the method includes receiving a plurality of photographic viewpoints of a pet body, creating a three-dimensional model based on the received plurality of photographic viewpoints, the three-dimensional model including a hollow internal compartment, and producing a stuffed animal based on the three-dimensional model. The stuffed animal pet urn may also include a head, a body, at least two or more legs, a tail, an internal hollow compartment, wherein the head, the body, the at least two or more legs and the tail are superimposed with a fur pattern and stuffed with a stuffing agent, and wherein the internal hollow compartment is configured to secure and retain an object.

BRIEF DESCRIPTION OF THE DRAWINGS

The foregoing summary, as well as the following detailed description of various embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

The presently disclosed subject matter is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies.

Figure 1:
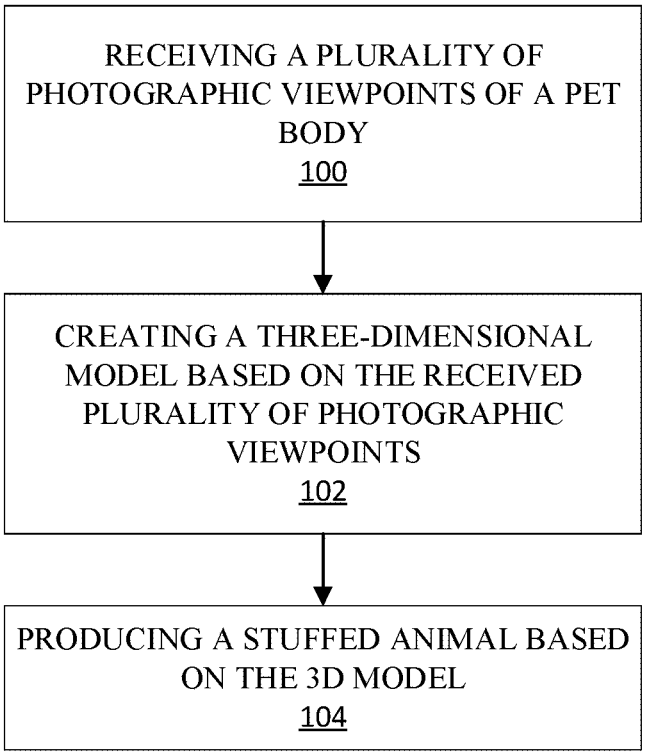
FIG. 1 is a flow chart of an example method for producing a stuffed animal pet urn in accordance with embodiments of the present disclosure.

The presently disclosed subject matter is now described in more detail. For example, FIG. 1 depicts a flow chart of an example method for producing a stuffed animal pet urn in accordance with embodiments of the present disclosure. As shown in FIG. 1, the process begins with receiving a plurality of photographic viewpoints of a pet body 302. The photographic viewpoints may be derived from various key angles of a pet body, including a front view, right side view, left side view, bottom view, top view, and a perspective view. The photographic viewpoints may be from any suitable photograph or media component, such as a two-dimensional (2D) image, three-dimensional (3D) image, film image, digital image, or handwritten drawing. The photographic viewpoints may capture all portions of the pet body, including, the head, neck, torso, arms, legs, back, tail, stomach, and side. The pet body may be a deceased body or a living body. The process continues by creating a three-dimensional model based on the received plurality of photographic viewpoints 102. The 3D model may be created using any 3D modeling software, such as AUTOCAD®, TEKLA®, or TINKERCAD®. Upon designing the 3D model using the 3D modeling software, the user may add details to the model according to the captured photographic images, such as placement of the head, eyes, ears, arms, legs, and tail. The 3D modeling software may also acquire measurement information of the pet body from the plurality of photographic viewpoints of the pet body. The measurement information may include metrics pertaining to inches, centimeters, or millimeters which determine the placement of certain anatomical structures (e.g. eyes, ears, arms, legs, and tail) should be located on the stuffed animal pet urn. The 3D model may also include a hollow internal compartment 400 that may be used to receive the ashes or remains of the cremated pet body. The hollow internal compartment may include a door or open slot that is configured to open and close in order to received and secure the ashes of the cremated pet body. The hollow internal compartment may be located underneath or at the bottom of the pet body or on the side of the pet body. The method also includes producing a stuffed animal based on the 3D model 104. When producing the stuffed animal pet urn, which is explained in greater detail below in FIG. 2, the 3D modeling software may print the model out on a 3D printing device such as FORMLABS®, ULTIAKER 3®, ROBO 3D R1®, or MAKERBOT REPLICATOR®. In an alternate embodiment, the process begins with an artist, sculptor, designer, or person having skill in designing physical models or stuffed animal pet urns, visually observing the pet body 302 and physically sketching and/or recording viewpoints or other measurement information pertaining to the pet body 302 for the purpose hand producing the two or more patterns for production of the animal pet urn.

Figure 2:
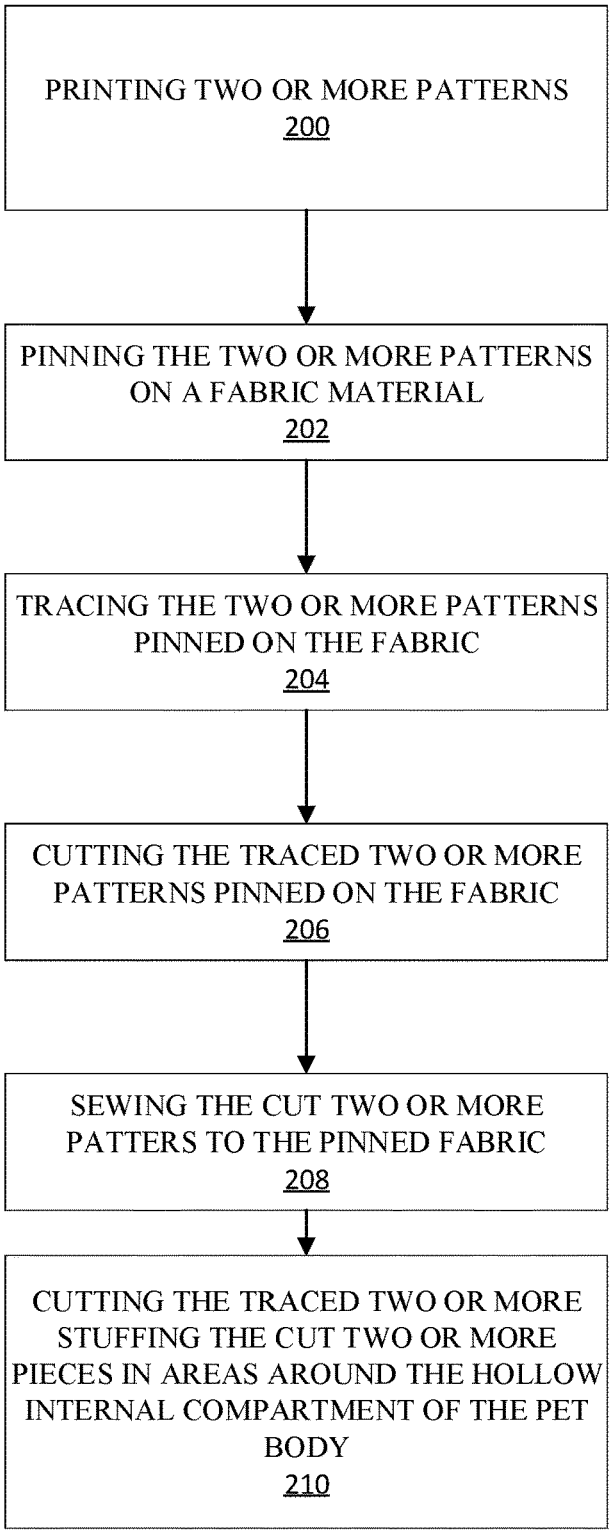
FIG. 2 is a flow chart of an example method for producing the stuffed animal pet urn in accordance with embodiments of the present disclosure.

Now referring to FIG. 2, which illustrates a more detail flow chart for producing a stuffed animal pet urn. For instance, at step 200, the process continues by printing two or more patterns 200. These patterns are derived from the measurement information from the pet body acquired during the modeling process described in step 104. The patterns may also be derived from the measurement information received, by hand, from the artist, sculptor, designer, or person having skill in designing physical models as they visually observed the pet body 302. The patterns may correspond to individual pieces of material, including but not limited to fabric, trial fabric, or related material, that represents the measurements and/or placement of the pet body's detail extremities. These extremities may include the head, eyes, ears, arms, legs, and tail. Once the two or more patterns are cut, the process continues by pinning the two or more patterns on a fabric material 202, tracing the two or more patterns pinned on the fabric 204, and cutting the traced two or more patterns pinned on the fabric 206. The process of pinning the two or more patterns on a fabric material includes stitching or weaving two pieces of fabric layered with right sides together. Here, the two or more patterns are pinned on the fabric and weaved along the pattern according to the measurement information as discussed above. A trace pen or other wet soluble fabric pen may be used to trace over the patterned areas of the fabric to ensure accuracy. The process further continues by sewing the cut two or more patterns to the pinned fabric 208, and stuffing the cut two or more patterns in areas around the hollow internal compartment of the pet body 210. The two or more pieces may be sewed together to facing right and the seams may be closed to the point of keeping at least one side open. The two or more patterns are sewed inside out through a left opening in order to be stuffed tight with stuffing material such as cotton. When sewing the cut two or more patterns to the pinned fabric, the two or more patterns may include the legs and tail patterns. These patterns may be mounted and may require one seam around edges of the pattern. When stuffing the cut two or more patters in areas around the hollow internal compartment of the pet body 210, an eraser end of a pencil or some other suitable object may be used to fill the stuffing material, such as cotton, within the sewed stuff animal pet urn. When conducting the stuffing step, the stuffing material is filled around the hollow internal compartment of the pet body. Artistic details, via coloring or airbrushing, may be added head, arms, legs, eyes, and tail for aesthetic purposes and in order to ensure proper resemblance of the departed pet is achieved. In an alternate embodiment, the processes described above may be completed by hand by an artist, sculptor, designer, or person having skill in designing physical models or stuffed animal pet urns. For example, the process of cutting the patterns 202, pinning the two or more patterns 204, tracing the two or more patterns 206, cutting the traced two or more patterns 208, sewing the cut two or more patterns, stuffing the cut two or more patterns 210, and mounting the two or more patterns may be completed by hand, after visually observing the pet body 302, by an artist, sculptor, designer, or person having skill in designing physical models or stuffed animal pet urns.

Figure 3:
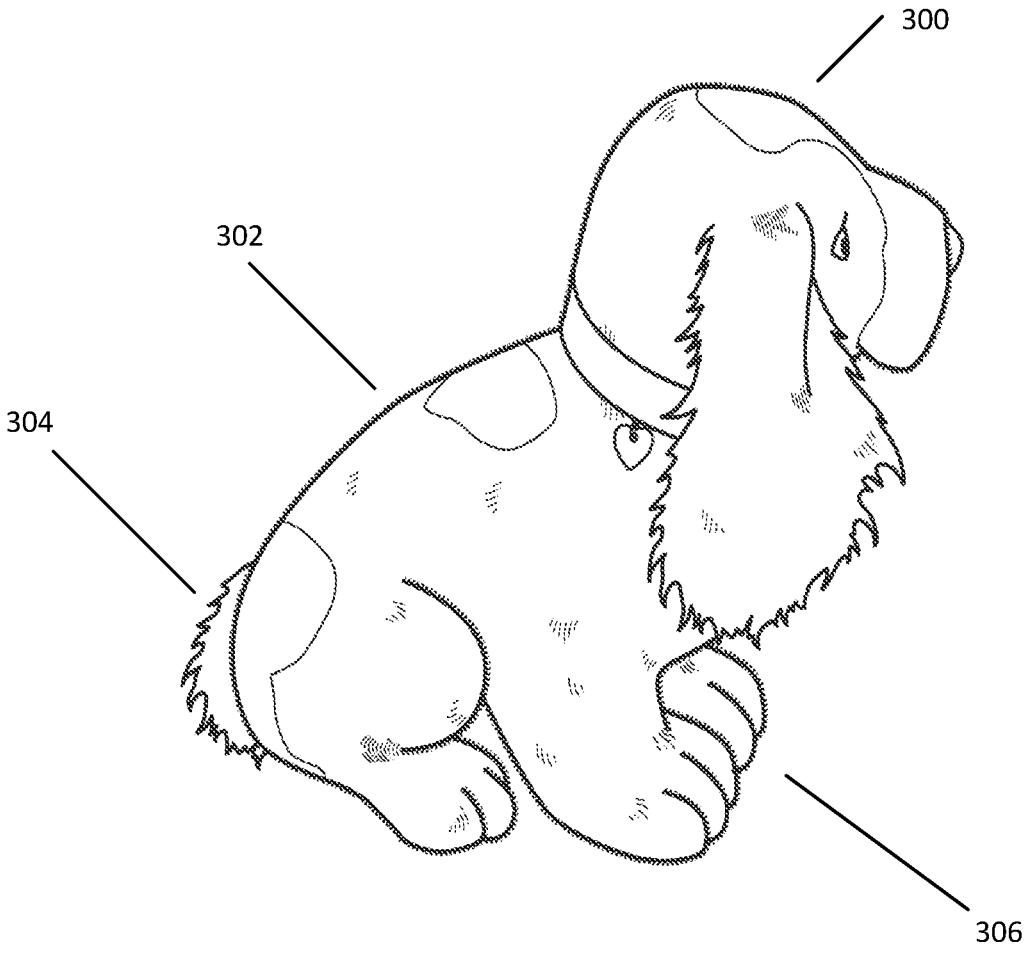
FIG. 3 is a perspective view of the stuffed animal pet urn in accordance with embodiments of the present disclosure.

FIG. 3 illustrates a perspective view of the stuffed animal pet urn in accordance with embodiments of the present disclosure. As shown, the stuffed animal pet urn is covered in fur and stuffed in accordance with the present disclosure. The head 300 is illustrated to resemble a dog. However, any pet, including a cat, horse, bird, or hamster may be used. The head 300 includes ears, a mouth, and eyes which may be created during the 3D modeling process described above. The body 302 further includes legs 306 and a tail 304.

Figure 4:
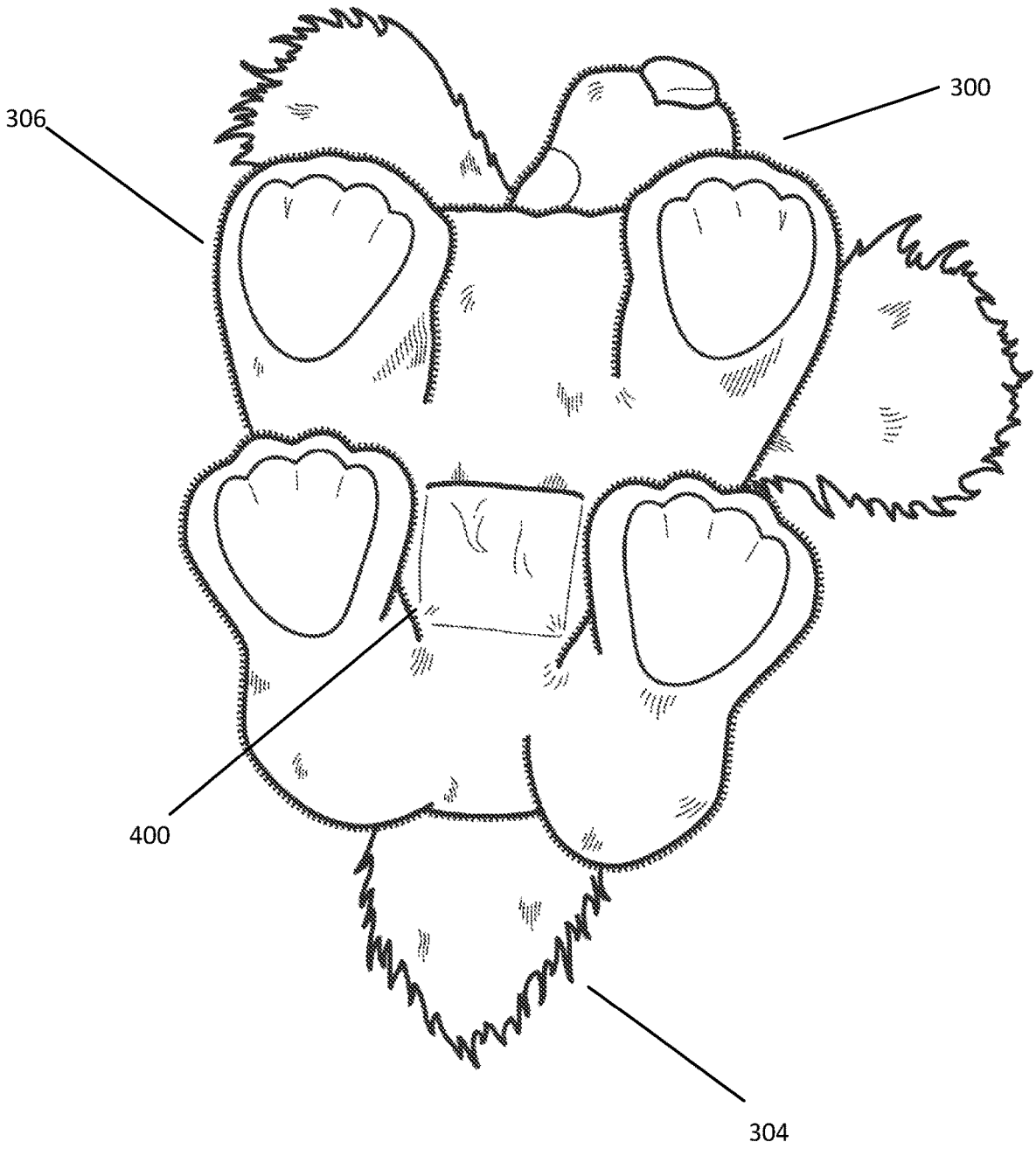
FIG. 4 is bottom view of the stuffed animal pet urn illustrating the internal hollow compartment in accordance with embodiments of the present disclosure.

Turning to FIG. 4, which illustrates bottom view of the stuffed animal pet urn illustrating the internal hollow compartment 400 in accordance with embodiments of the present disclosure. The internal hollow compartment 400 may be located in the center of the stuffed animal pet urn underbelly. However, the internal hollow compartment 400 may be located anywhere on the stuffed animal pet urn. As mentioned above, hollow internal compartment 400 that may be used to receive the ashes or remains of the cremated pet body. The hollow internal compartment 400 may include a door or open slot that is configured to open and close in order to received and secure the ashes of the cremated pet body.

Aspects of the present subject matter are described herein with reference to flowchart illustrations and/or block diagrams of methods, and apparatus (systems) according to embodiments of the subject matter. The flowchart and block diagrams in the Figures illustrate the architecture, functionality, and operation of possible implementations of systems and methods according to various embodiments of the present subject matter. In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A method for producing a stuffed animal pet urn, the method comprising:

receiving a plurality of photographic viewpoints of an actual animal and/or pet;

creating a three-dimensional model based on the received plurality of photographic viewpoints, the three-dimensional model including measurement information of the actual animal and/or pet, wherein creating the three-dimensional model comprises:

acquiring measurement information of the pet body from the plurality of photographic viewpoints of the pet body; and drawing two or more patterns based on the measurement information; and producing a stuffed animal pet urn based on the three-dimensional model, wherein the stuff animal pet urn comprises:

a head made in accordance with measurement information acquired from an actual animal and/or pet;

a body attached to the head and made in accordance with the measurement information;

at least two or more legs attached to the body and made in accordance with the measurement information;

a tail attached to the body and made in accordance with the measurement information; and an internal hollow compartment, wherein the head, the body, the at least two or more legs and the tail are superimposed with a fur pattern and stuffed with a stuffing agent made in accordance with the measurement information, and wherein the internal hollow compartment is configured to secure and retain an object, and wherein producing the stuffed animal pet urn based on the three-dimensional model comprises:

printing the two or more patterns;

pinning the two or more patterns on a fabric;

tracing the two or more patterns pinned on the fabric;

cutting the traced two or more patterns pinned on the fabric;

sewing the cut two or more patterns to the pinned fabric; and stuffing the cut two or more patterns in areas around the hollow internal compartment of the pet body.

2. The method of claim 1, wherein the plurality of photographic viewpoints comprises a front viewpoint, back viewpoint, right side viewpoint, left side viewpoint, and bottom viewpoint.

3. The method of claim 1, wherein the plurality of photographic viewpoints of the pet body comprises a plurality of viewpoints of a deceased animal.

4. The method of claim 1, wherein two or more patterns comprises a trace of a head, a body, an arm, a leg, and a tail.

5. The method of claim 1, wherein acquiring measurement information of the pet body comprises acquiring measurement information pertaining to eye placement, ear placement, and nose placement.

6. The method of claim 1, wherein producing the stuffed animal pet urn based on the three-dimensional model further comprises:

coloring and designing the patterns according to the plurality of photographic viewpoints of the pet body.

* * * * *